US010801120B2

(12) United States Patent
Uhland et al.

(10) Patent No.: US 10,801,120 B2
(45) Date of Patent: Oct. 13, 2020

(54) SYSTEMS AND METHODS FOR ELECTROPLATING SOURCES FOR ALPHA SPECTROSCOPY

(71) Applicant: Curium US LLC, St. Louis, MO (US)

(72) Inventors: William Claude Uhland, St. Louis, MO (US); Arend Booij, St. Louis, MO (US); Marjolijn Gerritsen, St. Louis, MO (US)

(73) Assignee: Curium US LLC, St. Louis, MO (US)

( * ) Notice: Subject to any disclaimer, the term of this patent is extended or adjusted under 35 U.S.C. 154(b) by 6 days.

(21) Appl. No.: 15/881,241

(22) Filed: Jan. 26, 2018

(65) Prior Publication Data

US 2018/0209059 A1 Jul. 26, 2018

Related U.S. Application Data

(60) Provisional application No. 62/450,849, filed on Jan. 26, 2017.

(51) Int. Cl.
*C25D 5/20* (2006.01)
*C25D 3/54* (2006.01)
(Continued)

(52) U.S. Cl.
CPC ..... *C25D 5/20* (2013.01); *C25D 3/54* (2013.01); *C25D 17/10* (2013.01); *C25D 21/10* (2013.01)

(58) Field of Classification Search
CPC ..... C25D 3/54
See application file for complete search history.

(56) References Cited

U.S. PATENT DOCUMENTS 5,167,779 A * 12/1992 Henig ..... C25D 21/10 204/201
5,462,649 A 10/1995 Keeney et al.
(Continued)

FOREIGN PATENT DOCUMENTS

KR 101560977 B1 10/2015
WO 2014124428 A1 8/2014

OTHER PUBLICATIONS

Foreman et al, A Modular System for Electroplating Alpha Nuclides, Analytica Chimica Acta, vol. 81, No. 2, Feb. 1976, pp. 413-417 (Year: 1976).*

(Continued)

*Primary Examiner* — Harry D Wilkins, III
(74) *Attorney, Agent, or Firm* — Polsinelli PC

(57) ABSTRACT

Disclosed herein are a system and method for electroplating an alpha emitting radionuclide, such as an actinide, for use in alpha spectroscopy. The electrodeposition system for electroplating an alpha emitting radionuclide can include an electroplating cell containing a solution of an electrolyte and the alpha emitting radionuclide, a metal target within the electroplating cell, and a metal anode at a distance from the metal target. The system also includes a platform for supporting the electroplating cell, coupling mechanism connected to the platform, an electric motor on the elastic cushion, and a flywheel with an uneven weight distribution operatively connected to the electric motor. Rotation of the unevenly distributed flywheel generates a vibration in the electroplating cell which dislodges gas bubbles that have formed between the metal target and the metal anode.

10 Claims, 8 Drawing Sheets

(51) Int. Cl.
*C25D 21/10* (2006.01)
*C25D 17/10* (2006.01)

(56) References Cited

U.S. PATENT DOCUMENTS

| | | | | |
|---|---|---|---|---|
| 5,653,860 | A | 8/1997 | Grant | |
| 6,103,295 | A | 8/2000 | Chan et al. | |
| 6,123,815 | A * | 9/2000 | Omasa | C23C 18/1653 204/222 |
| 6,254,757 | B1 | 7/2001 | Lashmore et al. | |
| 6,921,466 | B2 | 7/2005 | Hongo et al. | |
| 2001/0045360 | A1 | 11/2001 | Omasa | |
| 2002/0169353 | A1 | 11/2002 | Chan et al. | |
| 2008/0117711 | A1 | 5/2008 | Omasa | |
| 2013/0126337 | A1 | 5/2013 | Grant | |
| 2016/0122895 | A1 | 5/2016 | James et al. | |

OTHER PUBLICATIONS

Dos Santos et al, Characterization of electrodeposited uranium films, Jounral of Radioanalytical and Nuclear Chemistry, vol. 261, No. 1, Jan. 2004, pp. 203-209 (Year: 2004).*

Saliba-Silva et al, Acidic Aqueous Uranium Electrodeposition for Target Fabrication, 2013 International Nuclear Atlantic Conference, Recife PE, Brazil, Nov. 24-29, 2013, ISBN 978-85-99141-05-2, pp. 1-7 (Year: 2013).*

"Recess Definition" accessed at https://www.dictionary.com/browse/recess on Jan. 16, 2020 (Year: 2020).*

"Recess Synonyms" accessed at https://www.thesaurus.com/browse/recess on Jan. 16, 2020 (Year: 2020).*

International Search Report and Written Opinion dated Mar. 15, 2018 regarding PCT/US2018/015482, 9 pages.

English translation of Republic of Korea Application No. 101560977, published Oct. 15, 2015, 8 pages.

* cited by examiner

SYSTEMS AND METHODS FOR ELECTROPLATING SOURCES FOR ALPHA SPECTROSCOPY

CROSS-REFERENCE TO RELATED APPLICATIONS

This application claims the benefit under 35 U.S.C. § 119(e) to U.S. Provisional Application No. 62/450,849, filed Jan. 26, 2017, the entire contents of which are incorporated herein by reference in their entirety.

FIELD

The present disclosure relates to systems and methods for electroplating actinides onto a source in preparation for alpha spectroscopy to minimize gas bubbles between electrodes during electroplating.

BACKGROUND

Preparing alpha spectrometry sources requires plating a thin, uniform sheet of the material, such as an actinide, to minimize energy losses. If the coating is too thick, there will be attenuation of the alpha spectrum due to self-absorption. In addition, additional material cannot be covering the actinide, as this can also cause attenuation of the alpha spectrum.

Electrodeposition plays an important role in both purification and preparation of alpha spectrometry sources by providing a uniform and adherent source for high resolution alpha spectrometric measurement. However, during the electroplating procedure, various gas bubbles can form between the anode and the cathode. During an aqueous deposition process, gas is being formed at both electrodes. Hydrogen gas is being formed at the cathode, and oxygen gas at the anode. If left alone, these bubbles can act as insulators and slow or even stop the electroplating process.

BRIEF DESCRIPTION OF DRAWINGS

The description will be more fully understood with reference to the following figures and data graphs, which are presented as various examples of the disclosure and should not be construed as a complete recitation of the scope of the disclosure, wherein.

DETAILED DESCRIPTION

The disclosure can be understood by reference to the following detailed description, taken in conjunction with the drawings as described below. It is noted that, for purposes of illustrative clarity, certain elements in various drawings cannot be drawn to scale. In addition, numerous specific details are set forth in order to provide a thorough understanding of the implementations described herein. However, those of ordinary skill in the art will understand that the implementations described herein can be practiced without these specific details. In other instances, methods, procedures and components have not been described in detail so as not to obscure the related relevant feature being described. Also, the description is not to be considered as limiting the scope of the implementations described herein.

Several definitions that apply throughout this disclosure will now be presented. The term "coupled" as used herein can refer to the linking or connection of two objects. The coupling can be direct or indirect. An indirect coupling includes connecting two objects through one or more intermediary objects. Coupling can also refer to electrical or mechanical connections. Coupling can also include magnetic linking without physical contact.

Another term used herein is "electroplating cell." An electroplating cell is any container that can be used to conduct an electrodeposition process. For example, an electroplating cell can be a container which includes a cathode, an anode, and an electrolyte solution.

Another term used herein is "coupling mechanism" is a mechanism that allows for vibrational motion of the platform in a planar direction. For example, a coupling mechanism can be a ball bearing or an elastic cushion.

The present disclosure provides a system and method for the electrodeposition of alpha emitting radionuclides on a target for use in an alpha spectrometer by dislodging gas bubbles that form between the electrodes in an electroplating cell. The systems and methods herein provide for electroplating alpha emitting radionuclides in a thin, uniform sheet without the presence of gas bubbles. The reduction or absence of gas bubbles can reduce or prevent bubbles from acting as insulators or slow or even stop the electroplating process.

The electrodeposition system and method described herein provide for the electrodeposition of alpha emitting radionuclides onto a target that can then be counted under the vacuum of an alpha spectrometer. In various examples, the alpha emitting radionuclides can be actinides. Non-limiting examples of alpha emitting radionuclides include actinium, thorium, protactinium, uranium, neptunium, plutonium, americium, curium, berkelium, californium, einsteinium, fermium, mendelevium, nobelium, lawrencium, and any isotope thereof.

Figure 1:
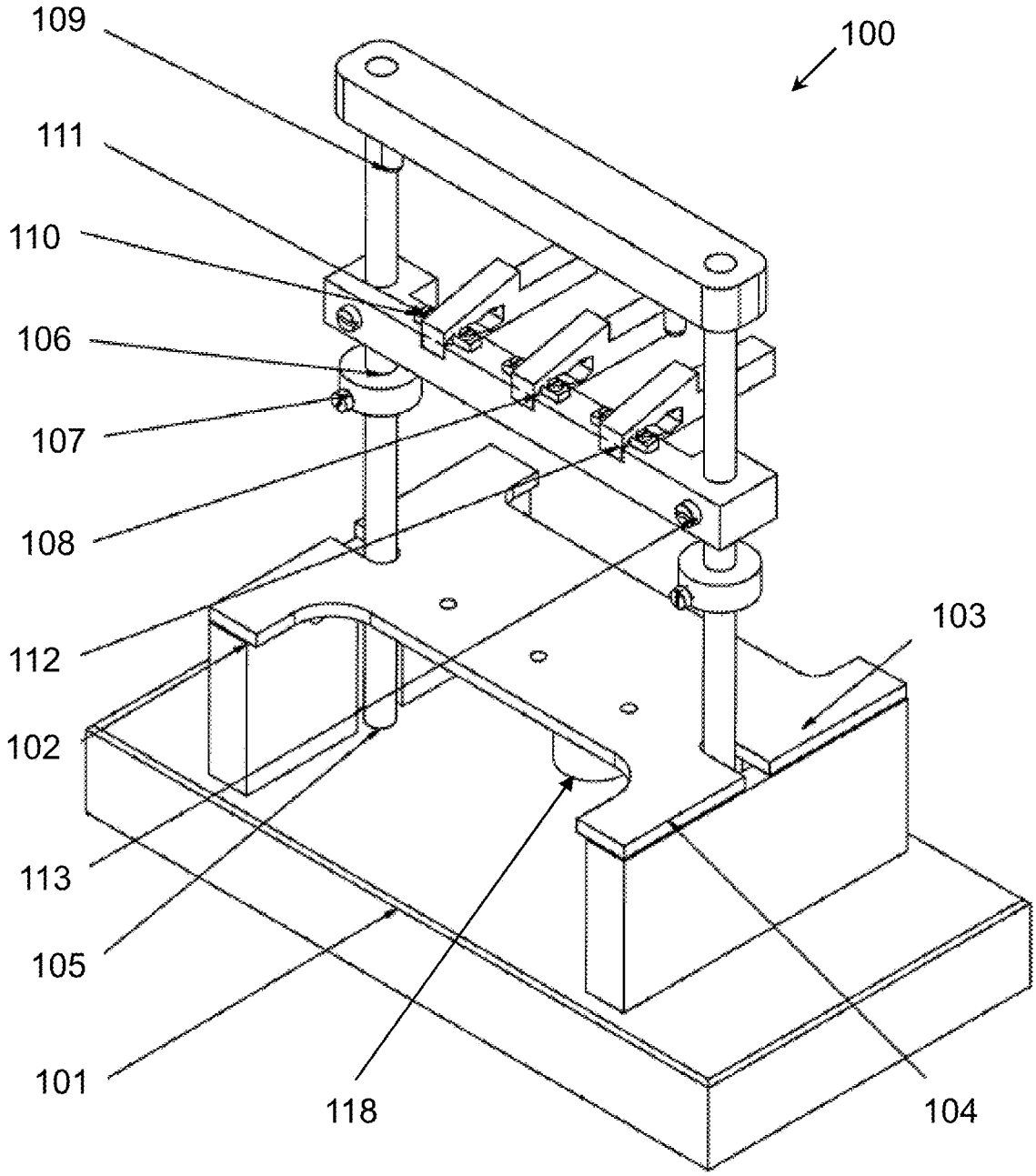
FIG. 1 is an isometric view of the electrodeposition system in one example.

As seen in FIG. 1, the electrodeposition system 100 can include a base plate 101, a platform 104 that is supported by a left platform support 102 and a right platform support 103, a clip bar 108, and a motor housing 118 with a motor 129 and flywheel 130. The clip bar 108 is suspended above the platform 104 with at least two shafts 105 that extend from the base plate 101 to a top shaft connection 109. The clip bar 108 can further include at least one clip holder 110 and at least one clip 112 in the clip holder 110. The electrodeposition system 100 can further include a coupling mechanism 128 that allows vibrational motion of the platform 104 in its plane. In an example, there can be sliding ring stops 106 on each of the shafts 105 below the clip bar 108. The sliding ring stops 106 can attach to the shafts 105 by screws 107, the clip bar 108 can attach to the shafts 105 by screws 113, and the clip holders 110 can attach to the clip bar 108 by screws 111.

The electrodeposition system 100 can further include at least one electroplating cell 117 supported by the platform 104. An electroplating cell 117 is any container that can be used to conduct an electrodeposition process. For example, the electroplating cell 117 may be configured to include a metal target 119 that acts as the cathode, a metal anode 116, and an electrolyte solution with the alpha emitting radionuclide.

Figure 5:
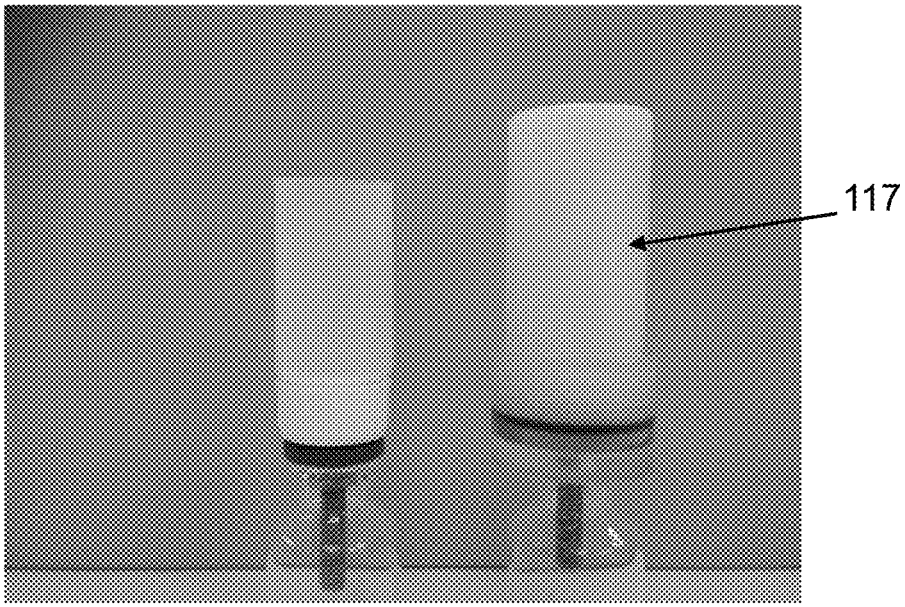
FIG. 5 is a photograph of electroplating cells that can be used in the electrodeposition system in various examples.

FIG. 5 is an example of an electroplating cell 117 that can be used with the electrodeposition system 100. In an example, the metal target 119 can be placed within the electroplating cell 117 or rest at the bottom of the electroplating cell 117 and the metal anode 116 can be hanging from a clip 112 in a clip holder 110 on a clip bar 108 or other support above the electroplating cell 117 by a wire 115. In this example, the metal anode 116 may be hanging such that the metal anode 116 sits in the electrolyte solution at the top of the electroplating cell 117. The electrodeposition system 100 can include any number of electroplating cells 117 needed for the desired output of electroplated disks. In an example, the electrodeposition system 100 can include at least about 1 electroplating cell, at least about 2 electroplating cells, at least about 3 electroplating cells, at least about 5 electroplating cells, or at least about 10 electroplating cells, each of which include their own cathode target and anode. In one example, the electrodeposition system 100 can have up to about 3 electroplating cells 117 with 3 adjustable plating positions with isolated contacts for the hanging metal anodes 116.

Figure 4:
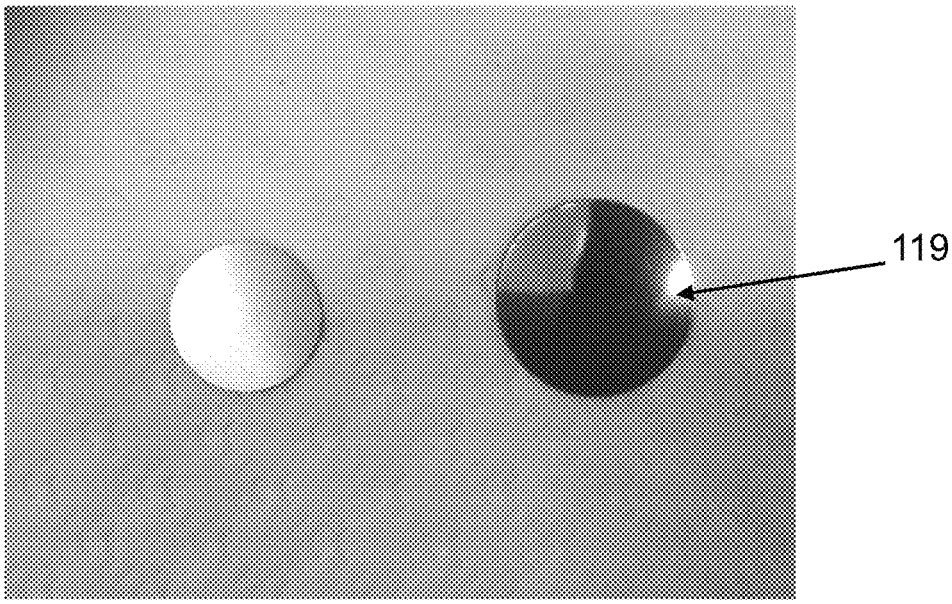
FIG. 4 is a photograph of metal targets that can be used in the electrodeposition system in various example.
Figure 6:
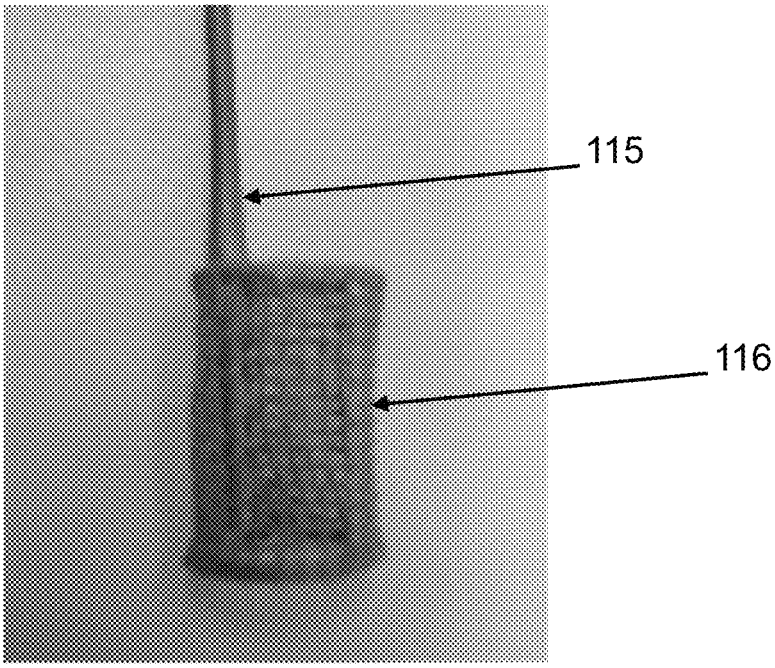
FIG. 6 is a photograph of a metal anode that can be used in the electrodeposition system in various examples.

The electrodeposition system 100 includes a metal target 119, as seen in FIG. 4. In various examples, the metal target 119 can be a metal disk, such as a stainless steel disk or another metal disk with a clean surface. The metal target can also take on other shapes as needed to fit within an alpha spectrometer. The electrodeposition system 100 further includes a metal anode 116, as seen in FIG. 6. The metal anode 116 can include, but is not limited to platinum, a platinum-iridium alloy, or other noble/inert metals, including for example ruthenium, rhodium, palladium, silver, osmium, iridium, platinum, and gold. The metal anode 116 can be suspended from a wire 115 that is held in place by a clip 112 on the clip bar/holder 108/110 of the electrodeposition system 100. In at least one example, all materials used in the electroplating cell 117 are chemical and corrosion resistant. The cathode and the anode can together be referred to as the electrodes of the electroplating cell 117.

Further included in the electrodeposition system 100 is an elongated clip bar 108 that is suspended above the platform 104 by at least two shafts 105 and spans the length of the platform 104. As seen in FIG. 1, FIG. 2H, and FIG. 2K, the clip bar 108 can have multiple grooves for receiving a clip holder 110 and/or a clip 112. In one example, a clip holder 110 can sit in the groove of the clip bar 108 and a clip 112 can attach to the clip holder 110. In various examples, the clip bar 108 can include at least three grooves such that the clip bar 108 can hold at least three clips 112. Each of the at least three clips 112 can be used to suspend a metal anode 116 by a wire 115 into at least three separate electroplating cells 117. The clip bar 108 can further include at least two openings, each for receiving a shaft 105. The openings can be on opposite ends of the clip bar 108 as to not interfere with the clips 112 on the clip bar 108 or the electroplating cells 117 below the clip bar 108. Screws 113 can be used to adjust the height of the clip bar 108 above the platform 104.

Figure 2A:
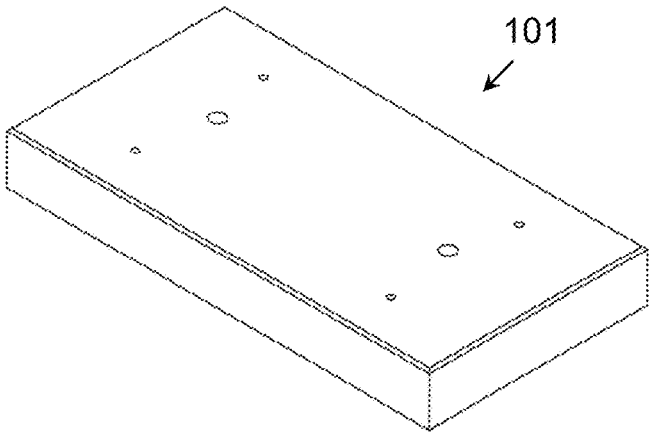
FIG. 2A is an isometric view of the base plate in one example.
Figure 2B:
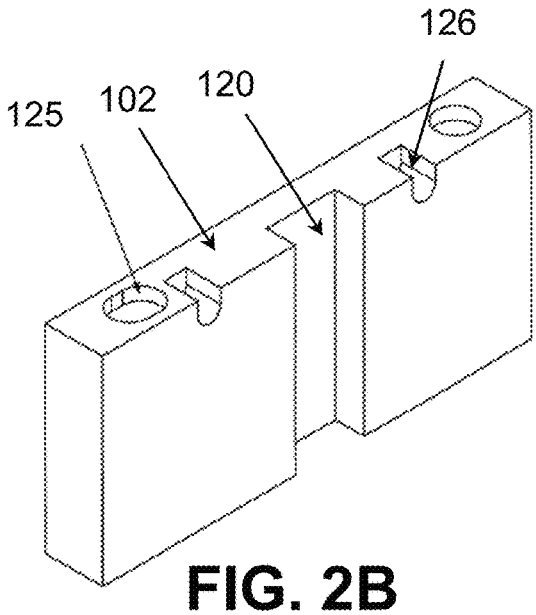
FIG. 2B is an isometric view of the left platform support in one example.
Figure 2C:
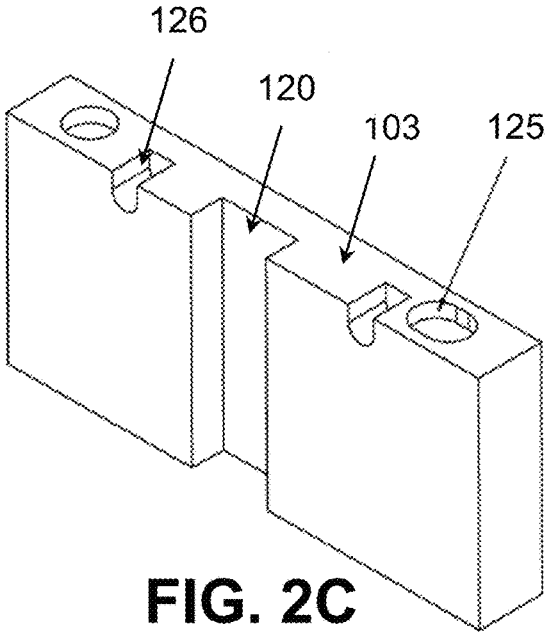
FIG. 2C is an isometric view of the right platform support in one example.

As seen in FIG. 1 and FIG. 2A, the base plate 101 supports the electrodeposition system 100. In an example, the base plate 101 may be about 30 cm to about 35 cm in length, about 15 cm to about 20 cm in width, and about 3 cm to about 5 cm in height. The platform 104 is supported by a left platform support 102 and a right platform support 103. The left platform support 102 and the right platform support 103 may be about 10 cm to about 20 cm in length, about 2 cm to about 5 cm in width, and about 5 cm to about 10 cm in height. In an example, the platform 104 is about 20 cm to about 25 cm in length, about 10 cm to about 20 cm in width, and about 0.5 cm to about 1 cm in thickness.

Figure 2D:
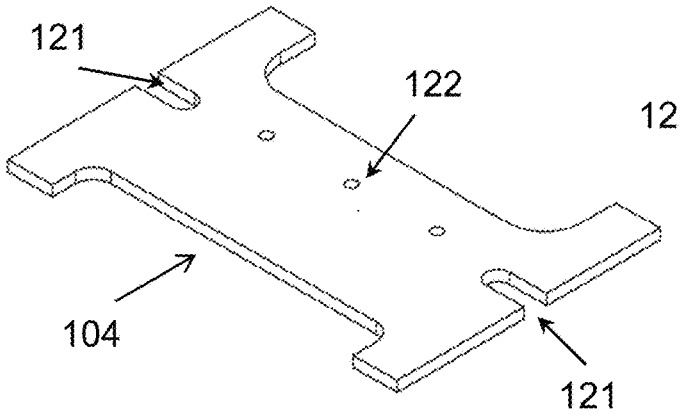
FIG. 2D is an isometric view of the platform in one example.
Figure 2E:
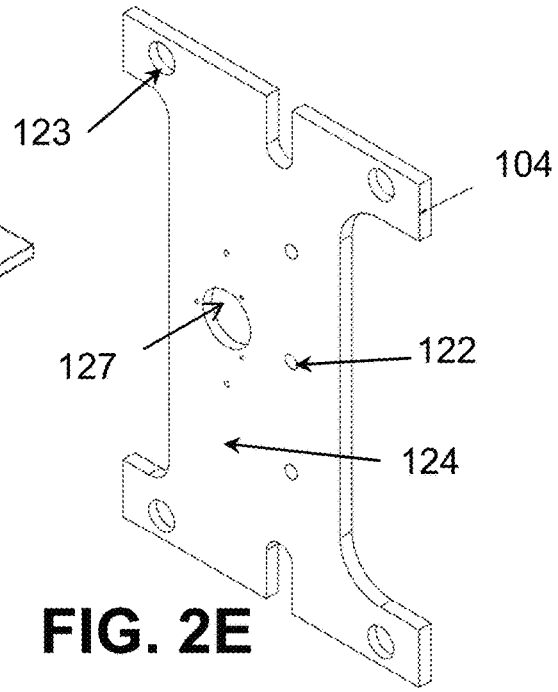
FIG. 2E is another view showing the bottom of the platform in one example.
Figure 3A:
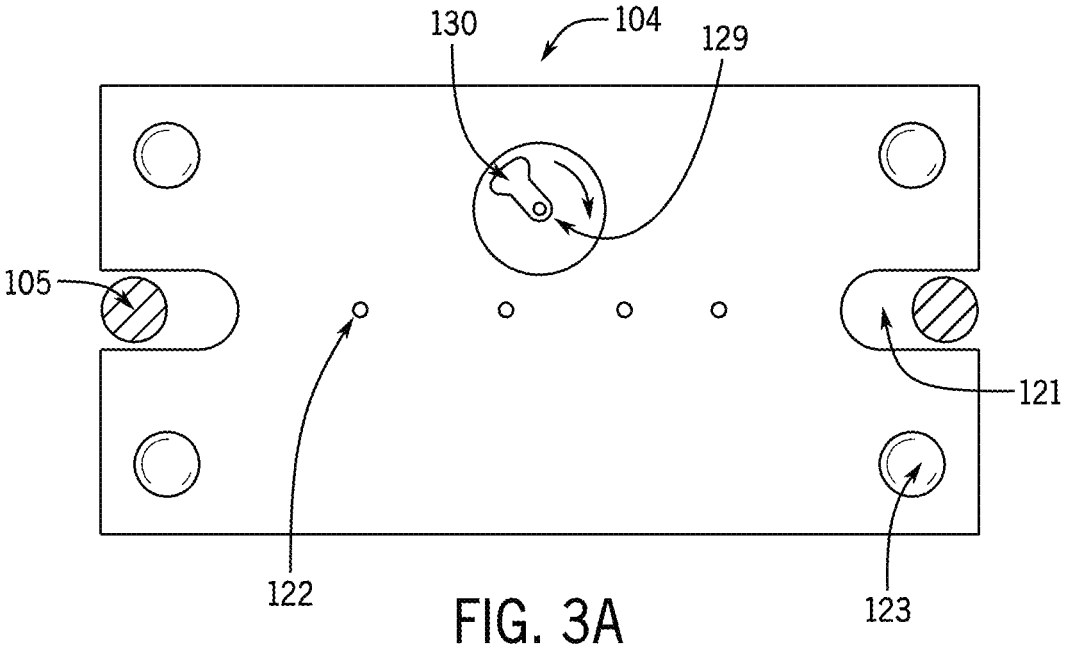
FIG. 3A is top view of the platform in one example.

The platform 104, as seen in FIG. 2D, FIG. 2E, and FIG. 3A, has a general rectangular or "I" shape with grooves 121 for guiding the shafts 105 in a vertical orientation. In an example, the width and length of the grooves 121 are larger than the diameter of the shafts 105 such that the shafts 105 within the grooves 121 do not make contact with the platform 104 and allow for the vibrational movement of the platform 104. The platform 104 can include openings 122 that extend the full thickness of the platform 104 for accepting or connecting the cathode or metal target 119 in the electroplating cell 117. The number of openings 122 corresponds to the number of electroplating cells 117 being supported by the platform 104. The platform 104 can also include a motor recess 127 for receiving the motor housing 118 containing the motor 129 and the flywheel 130. In various examples, the motor housing 118 may or may not contact the platform 104. The platform 104 can be made of PCV to provide for easy transfer of the vibrational motion from the motor 129 and flywheel 130 to the platform 104.

Figure 3B:
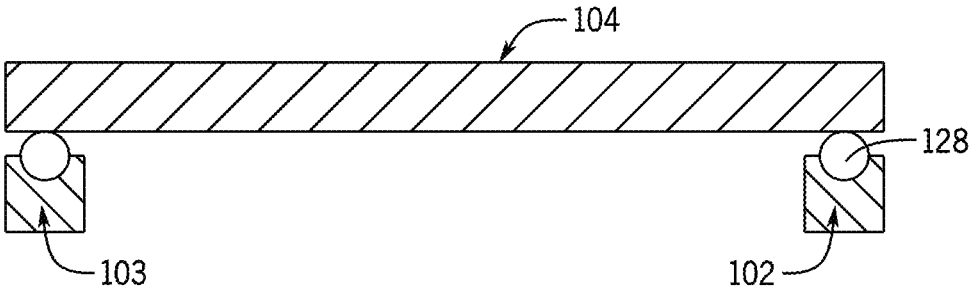
FIG. 3B is a side view of the platform, coupling mechanism and platform supports in one example.

As illustrated in FIG. 2E, the platform 104 can also include receiving recesses 123 on the lower surface 124 of the platform 104. In an example, the platform 104 can include at least 2 receiving recesses 123 or at least 4 receiving recesses 123. The receiving recesses 123 can be on each corner of the platform 104 and may not extend the full thickness of the platform 104. As seen in FIG. 3B, the system 100 can include at least 2 or at least 4 coupling mechanisms 128 which can be situated within or be incorporated into the receiving recesses 123. The coupling mechanisms 128 can extend beyond the lower surface 124 of the platform 104 such that the platform 104 rests on the coupling mechanism 128 when the platform 104 rests on the left and right platform supports 102/103. In an example, the coupling mechanism 128 can be situated within corresponding support receiving recesses 125 on the left and right platform supports 102/103. The left platform support 102 can include at least one or at least two support receiving recesses 125 and the right platform support 103 can include at least one or at least two support receiving recesses 125. In an example, the left platform support 102 can couple to at least one coupling mechanism 128 on the lower surface 124 of a first end of the platform 104 and the right platform support 103 can couple to at least one coupling mechanism 128 on the lower surface 124 of a second end of the platform 104. In various examples, the coupling mechanisms 128 can be ball bearings, an elastic cushion, or any material which allows for the vibrational motion of the platform 104 by transferring the motion of the motor 129 and flywheel 130 to the platform 104. The ball bearings can be stainless steel balls having a diameter of about 1 cm in one example. If ball bearings are used as the coupling mechanism 128, the receiving recesses 123 and the support receiving recesses 125 can have a length, width, or both that is wider than the point of contact for the ball bearing to allow for free motion of the platform in a plane along its width and/or length.

The elastic cushion can be made of any elastomeric material that allows for the transfer of energy from the flywheel to the electroplating cells. In one example, the elastic cushion is rubber. The elastic cushion can be any shape or size necessary to suspend and cushion the platform 104. In various aspects, the elastic cushion can be circular, oval, or rectangular. In another example, the platform 104 includes at least two tabs (not shown) made of the elastic cushion material that can be inserted into corresponding support grooves 126 on the left and right platform supports 102/103 to allow vibrational movement of the platform 104. In an example, the platform 104 can include at least 2 tabs or at least 4 tabs which can be seated within at least at least one support groove 126 or at least two support grooves 126 on each of the left and right platform support 102/103, respectively. In yet another example, the platform 104 does not couple or touch the left or right platform supports 102/103.

Figure 2F:
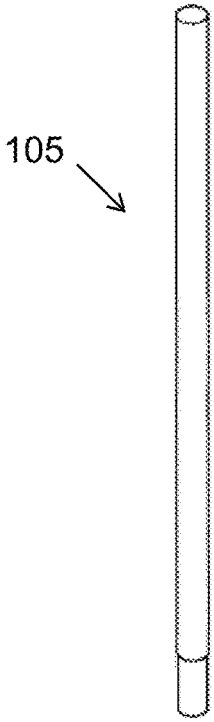
FIG. 2F is an view of the shaft in one example.
Figure 2G:
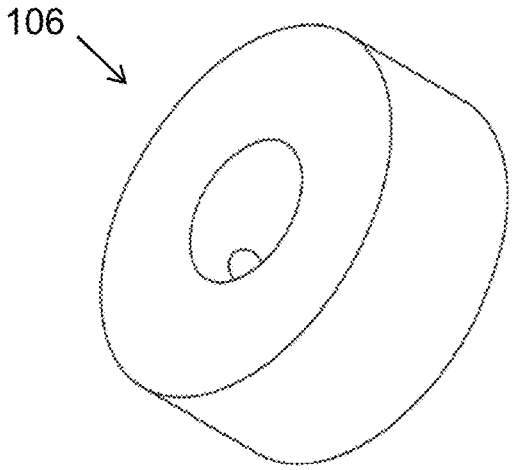
FIG. 2G is an isometric view of the sliding ring in one example.
Figure 2H:
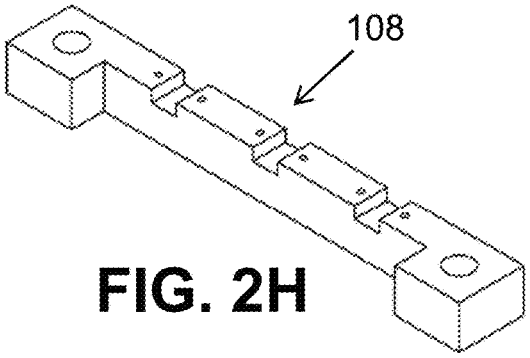
FIG. 2H is an isometric view of the clip bar in one example.
Figure 2I:
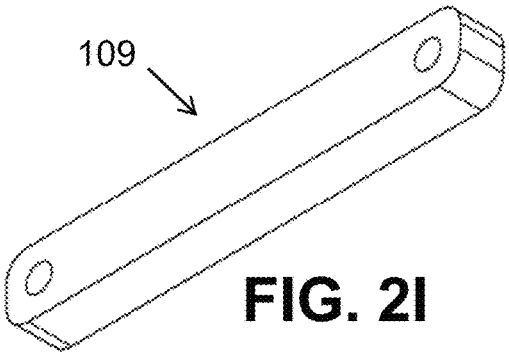
FIG. 2I is an isometric view of the top shaft connection in one example.
Figure 2J:
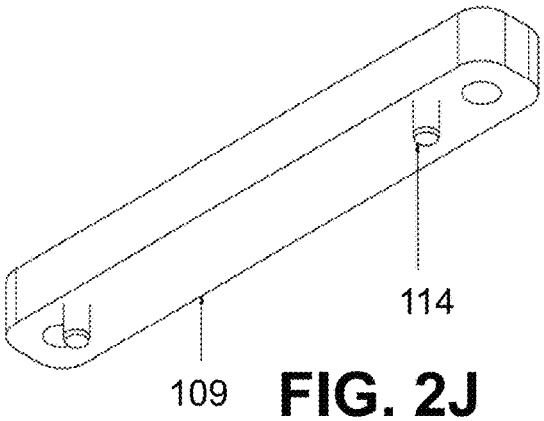
FIG. 2J is another view showing the bottom of the top shaft connection in one example.
Figure 2K:
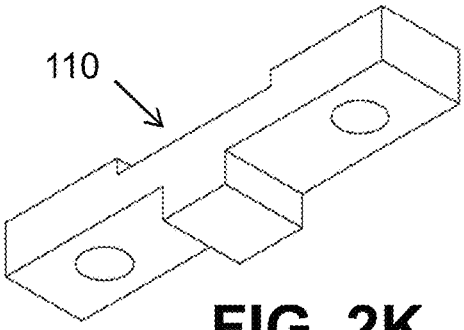
FIG. 2K is an isometric view of the clip holder in one example.

As seen in FIGS. 2B and 2C, the left and right platform supports 102/103 can also include longitudinal grooves 120 for guiding the shafts 105 in a vertical orientation. The shafts 105, as seen in FIG. 2F, can connect to the base plate 101 at a first end and connect to a top shaft connection 109 at a second end. FIG. 2I shows that the top shaft connection 109 can include at least two openings for receiving the shafts 105 at opposing ends of the top shaft connection 109. As seen in FIG. 2J, the top shaft connection 109 can further include at least two parallel pins 114 for spacing the distance between the clip bar 108 and the top shaft connection 109. In various examples, the clip bar 108, the platform 104, the left platform support 102, and the right platform support 103 can attach to or rest on the shafts 105 at points between the base plate 101 and the top shaft connection 109. In other examples, as seen in FIG. 1 and FIG. 2G, the electrodeposition system 100 can include sliding ring stops 106 coupled to the rods with screws 107 between the clip bar 108 and the platform 104. The sliding ring stops 106 can be set at a height on the shafts 105 such that it limits the distance that the clip bar 108 can be lowered. The sliding ring stops 106 therefore prevent the metal anode 116 from being lowered a distance in which it would touch the metal target 119 and short the electroplating cell.

Figure 7:
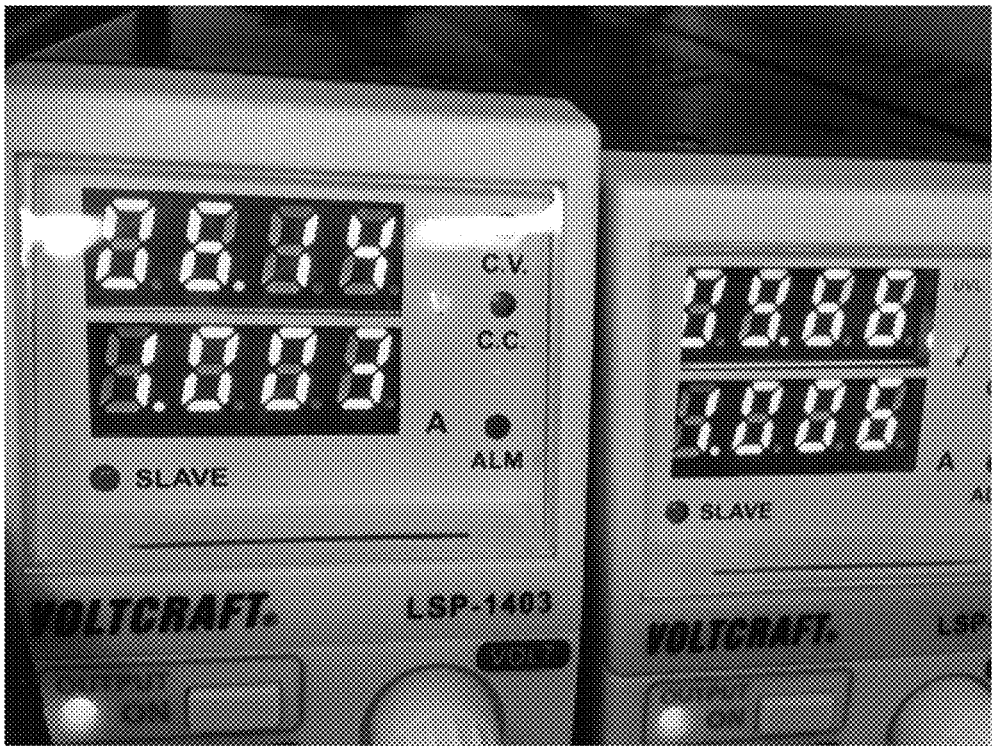
FIG. 7 is a photograph of a current source that can be used in the electrodeposition system in various examples.
Figure 8:
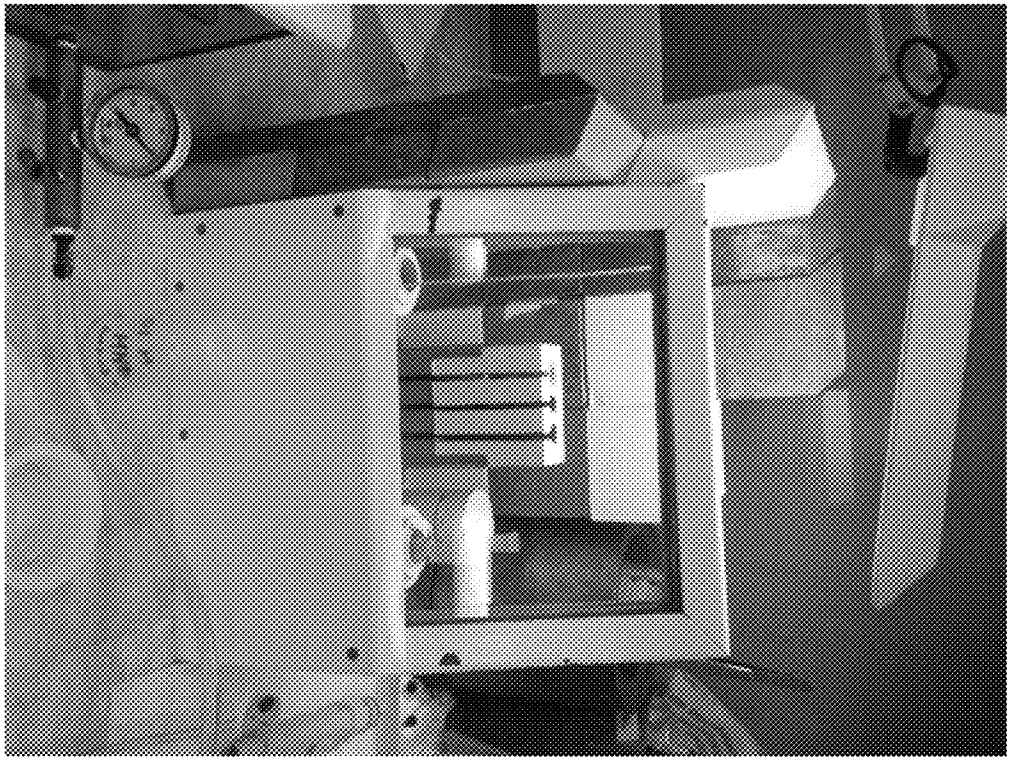
FIG. 8 is a photograph of an alpha fume hood that can be used with the electrodeposition system in various examples.

The electrodeposition system 100 can further include a current source and/or a voltage source, as seen in FIG. 7, to provide current between the anode and cathode and drive the deposition of the alpha emitting radioniculide on the cathode metal target 119. The current source and/or the voltage source can provide stable and constant current or potential and both values can be adjustable.

Figure 2L:
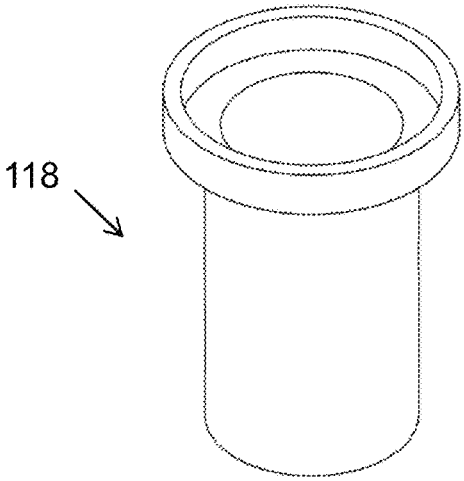
FIG. 2L is an isometric view of the motor housing in one example.

The electrodeposition system 100 can further include a motor 129 and a flywheel 130. In an example, the motor and the flywheel can be contained within the motor housing 118, as seen in FIG. 1, FIG. 2L, and FIG. 3A. In various examples, the motor 129 in the motor housing 118 can rest on top of, sit below, or be mounted on the base plate 101 or the platform 104. The motor 129 is coupled to the flywheel 130, and the flywheel 130 can be in any orientation such that it acts as a mechanical oscillator. The motor 129 can be configured to rotate the flywheel 130. In addition, the platform 104 supporting the electroplating cell 117 of the electrodeposition system 100 can be vibrated by the motion of the motor 129 and flywheel 130 through the coupling mechanism 128. The coupling mechanism 128 provides for transferring the kinetic energy from the flywheel 130 of the motor 129 to the electroplating cell 117 sitting on the platform 104. In an example, the motor can be mounted on the elastic cushion or the motor can be below the elastic cushion. The motor can be an electric motor that is capable of rotating the flywheel. In various examples, the motor frequency can range from about 1 Hz to about 5 Hz, from about 5 Hz to about 10 Hz, from about 10 Hz to about 15 Hz, from about 15 Hz to about 20 Hz, from about 20 Hz to about 25 Hz, and from about 25 about 30 Hz. In an example, the motor can rotate the flywheel at a speed ranging from about 1 Hz to about 10 Hz. The flywheel can be rotated at about 2 Hz to about 3 Hz, in one example. The speed of rotation of the motor can be adjustable such that the rotation is sufficient to create a vibration in the flywheel to dislodge gas bubbles while not strong enough to cause the electrolyte solution to spill out of the electroplating cell.

To create the vibration, the flywheel can have an uneven weight distribution. In an example, the flywheel can be heavier on one side than the other side to create the uneven weight distribution. The uneven weight distribution in combination with the rotation of the flywheel can cause the flywheel to vibrate and therefore cause the platform holding the electroplating cell(s) to vibrate. The vibration can then cause any bubbles that have formed between the electrodes of the electroplating cell to be dislodged or rocked up to the surface of the electrolyte solution and therefore the bubbles are no longer between the electrodes to interfere with the electroplating process.

Gas bubbles can form between the metal anode and the metal target receiving the alpha emitting radionuclide. If left alone, the bubbles can act as insulators and slow or even stop the electroplating process. Because of the sensitivities of alpha spectroscopy, any impurities can affect the output of the spectrometer. For example, impurities or disruption of the electroplating process can result in a false lower energy reading or broader peaks in the spectra. Therefore, the electrodeposition system can be used when electroplating an alpha emitting radionuclide on a metal target to remove the bubbles from between the electrodes and reduce the likelihood of impurities or an incomplete deposition.

The method for electroplating an alpha emitting radionuclide on a metal target for alpha spectroscopy can include vibrating an electroplating cell using an unevenly distributed flywheel to dislodge gas bubbles that have formed in the electrolyte solution between the electrodes of the electroplating cell. The vibration can dislodge the gas bubbles to the surface of the solution such that the gas bubbles do not interfere with, slow, or stop the electroplating process. The method can further include chemically purifying an alpha emitting radionuclide, transferring the purified alpha emitting radionuclide to a suitable electrolyte, placing the electrolyte-radionuclide solution into an electroplating cell containing a metal target, and inserting a metal anode into the solution prior to vibrating the electroplating cell. The electroplating cell, including the metal anode, is then placed onto a platform of the electrodeposition system for dislodging and removing gas bubbles from between the electrodes of the electroplating cell.

The method can further include using a current source and/or a voltage source to apply a current or voltage between the anode and cathode to drive the deposition of the alpha emitting radioniculide on the cathode metal target. In an example, the current between the electrodes can range from about 0.5 A to about 5 A. In various examples, the current may range from about 0.5 A to about 1.5 A, from about 1 A to about 2 A, from about 1.5 A to about 2.5 A, from about 2 A to about 3 A, from about 2.5 A to about 3.5 A, from about 3 A to about 4 A, from about 3.5 to about 4.5 A, and from about 4 A to about 5 A. In one example, the current can be about 1 A. In another example, the voltage provided by the current source and/or voltage source can range from about 5 V to about 10 V, from about 10 V to about 15 V, from about 15 V to about 20 V, and from about 20 V to about 25 V. Since gas bubbles have a higher electrical resistance than either the alpha emitting radionuclide or the electrolyte solution itself, the amount of gas has a significant effect on the current at a given applied voltage. For example, a high amount of bubbles between the electrodes can require a larger current to drive the electrodeposition, or could even stop the electrodeposition process altogether before it is complete. Therefore, the electrodeposition method provided herein, which either provides a low amount of bubbles or no bubbles between the electrodes, can require a lower current and/or voltage than conventional electrodeposition without the removal or reduction of the gas bubbles. The electrodeposition method thus provides a more reliable and consistent method for electrodeposition.

The electroplating process should be run long enough for the alpha emitting radionuclide to be deposited on the metal target. If the amount of alpha emitting radionuclide is too thick on the metal target, then the resulting alpha spectroscopy signal can be attenuated. In at least one example, only a few trillion atoms can be deposited on the metal target, which results in no measurable thickness and no visible quantities. The electrodeposition process can run for about 30 minutes to about 2 hours. In at least one example, the electrodeposition process can run for about 1 hour.

Having described several examples, it will be recognized by those skilled in the art that various modifications, alternative constructions, and equivalents can be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed examples teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An electrodeposition system for electroplating an alpha emitting radionuclide comprising:

at least three electroplating cells, each comprising:

a solution comprising an electrolyte and the alpha emitting radionuclide;

a metal target, wherein the metal target is a cathode; and a metal anode at a distance from the metal target;

a platform operable to support the electroplating cell, the platform comprising a motor recess;

a coupling mechanism coupled to the platform;

a motor housing comprising:

an electric motor; and a flywheel with an uneven weight distribution coupled to the electric motor, wherein the motor housing is received within the motor recess of the platform, and a clip bar supported above the platform using at least two shafts, wherein the clip bar comprises at least three clips such that the metal anode is suspended by a wire from a clip on the clip bar above each electroplating cell and placed in the solution within the electroplating cell, wherein the alpha emitting radionuclide is electroplated on the metal target.

2. The electrodeposition system of claim 1, further comprising a current source to generate a current between the metal target and the metal anode.

3. The electrodeposition system of claim 1, wherein the alpha emitting radionuclide is an actinide.

4. The electrodeposition system of claim 1, wherein the flywheel rotates to generate a vibration of the platform and the at least one electroplating cell through the coupling mechanism.

5. The electrodeposition system of claim 4, wherein the vibration of the at least one electroplating cell dislodges gas bubbles that have formed between the metal target and the metal anode.

6. The electrodeposition system of claim 1, wherein the metal target comprises a stainless steel disk.

7. The electrodeposition system of claim 1, wherein the metal anode comprises platinum.

8. An electrodeposition system for electroplating an alpha emitting radionuclide comprising:

a platform operable to support at least three electroplating cells, the platform comprising a motor recess;

a coupling mechanism coupled to the platform;

an electric motor proximate to the platform;

a flywheel with an uneven weight distribution coupled to the electric motor, wherein the electric motor and flywheel are received within the motor recess; and a clip bar supported above the platform using at least two shafts, wherein the clip bar comprises at least three clips.

9. The electrodeposition system of claim 8, wherein the electroplating cell further comprises:

a solution comprising an electrolyte and the alpha emitting radionuclide;

a metal target, wherein the metal target is a cathode; and a metal anode at a distance from the metal target.

10. The electrodeposition system of claim 9, wherein the clip bar comprises at least one clip such that the metal anode is suspended by a wire from a clip on the clip bar above each electroplating cell and placed in the solution within the electroplating cell.

* * * * *